US011186778B2

(12) United States Patent
Crum et al.

(10) Patent No.: US 11,186,778 B2
(45) Date of Patent: Nov. 30, 2021

(54) SYSTEM AND METHOD FOR REPAIRING A COKE OVEN

(71) Applicant: SUNCOKE TECHNOLOGY AND DEVELOPMENT LLC, Lisle, IL (US)

(72) Inventors: Jason Crum, Lisle, IL (US); Mark Anthony Ball, Richlands, VA (US); Gary Dean West, Lisle, IL (US); John Francis Quanci, Haddonfield, NJ (US); Chun Wai Choi, Chicago, IL (US)

(73) Assignee: SUNCOKE TECHNOLOGY AND DEVELOPMENT LLC, Lisle, IL (US)

( * ) Notice: Subject to any disclaimer, the term of this patent is extended or adjusted under 35 U.S.C. 154(b) by 0 days.

(21) Appl. No.: 17/076,563

(22) Filed: Oct. 21, 2020

(65) Prior Publication Data

US 2021/0032541 A1 Feb. 4, 2021

Related U.S. Application Data

(62) Division of application No. 15/987,860, filed on May 23, 2018, now Pat. No. 10,851,306.
(Continued)

(51) Int. Cl.
*C10B 29/06* (2006.01)
*C10B 29/02* (2006.01)
(Continued)

(52) U.S. Cl.
CPC ..... *C10B 29/06* (2013.01); *C10B 29/02* (2013.01); *F27D 1/004* (2013.01); *F27D 1/0033* (2013.01);
(Continued)

(58) Field of Classification Search
CPC ..... C10B 29/00; C10B 29/02; C10B 29/04; C10B 29/06; C10B 29/08; C10B 41/00;
(Continued)

(56) References Cited

FOREIGN PATENT DOCUMENTS

JP H0654753 U * 7/1994
JP 2010229239 A * 10/2010

OTHER PUBLICATIONS

Espacenet English translation of Suzuki et al. (JP 2010-229239 A).*
Espacenet English translation of JP H06-54753 U.*

* cited by examiner

*Primary Examiner* — Jonathan Luke Pilcher
(74) *Attorney, Agent, or Firm* — Perkins Coie LLP

(57) ABSTRACT

A system and method for repairing a coke oven having an oven chamber formed from ceramic bricks. A representative system includes a insulated enclosure insertable into the oven chamber and includes removable insulated panels that define an interior area for workers to work in. The insulated enclosure is movable between an expanded configuration and a compact configuration and moving the enclosure to the expanded configuration will decrease the distance between the insulated enclosure and the walls of the oven chamber. Removing the panels exposes the ceramic bricks and allows workers within the interior area to access and the bricks and repair the oven chamber while the oven chamber is still hot. A loading apparatus lifts and inserts the insulated enclosure into the oven chamber. The insulated enclosure can be coupled to additional insulated enclosures to form an elongated interior area.

15 Claims, 6 Drawing Sheets

Related U.S. Application Data

(60) Provisional application No. 62/510,109, filed on May 23, 2017.

(51) Int. Cl.

| | |
|---|---|
| ***F27D 1/00*** | (2006.01) |
| ***F27D 1/02*** | (2006.01) |
| ***F27D 1/12*** | (2006.01) |
| *C10B 15/02* | (2006.01) |

(52) U.S. Cl.
CPC ..... *F27D 1/0043* (2013.01); *F27D 1/02* (2013.01); *F27D 1/12* (2013.01); *C10B 15/02* (2013.01)

(58) Field of Classification Search
CPC ..... C10B 39/14; C10B 45/00; B65D 21/086; F16L 59/029; F27D 1/0033; F27D 1/04; F27D 1/0043; F27D 1/03; F27D 1/12; F27D 1/16; F27D 2001/0046; F27D 2001/005; F27D 2001/161
USPC ..... 432/76
See application file for complete search history.

SYSTEM AND METHOD FOR REPAIRING A COKE OVEN

CROSS-REFERENCE TO RELATED APPLICATION(S)

This application is a divisional application of U.S. patent application Ser. No. 15/987,860 filed May 23, 2018, which claims the benefit of priority to U.S. Provisional Application No. 62/510,109, filed May 23, 2017, the disclosure of which is incorporated herein by reference in its entirety.

TECHNICAL FIELD

The present technology relates to coke ovens and in particular to methods and apparatus for repairing coke ovens to improve the oven life and increase coke yield from the ovens.

BACKGROUND

Coke is a solid carbon fuel and carbon source used to melt and reduce iron ore in the production of steel. Coking ovens have been used for many years to convert coal into metallurgical coke. In one process, known as the "Thompson Coking Process," coke is produced by batch feeding pulverized coal to an oven that is sealed and heated to very high temperatures for 24 to 48 hours under closely-controlled atmospheric conditions. During the coking process, the finely crushed coal devolatilizes and forms a fused mass of coke having a predetermined porosity and strength. Because the production of coke is a batch process, multiple coke ovens are operated simultaneously.

Coke ovens are typically constructed of refractory bricks that include alumina, silica, and/or other ceramic materials. These refractory bricks are capable of withstanding high temperatures and typically retain heat for an extended period. However, the refractory bricks can be brittle and can crack, which decreases the coke-producing ability of the coke oven. To repair the coke oven, workers are often required to enter the coke oven and replace the broken bricks. Coke ovens operate at extremely high temperatures that are unsuitable for workers to enter and enabling the workers to comfortably enter the coke oven requires decreasing the temperature of the coke oven. However, the temperature within coke ovens is typically never allowed to decrease too far as doing so can potentially damage the ovens.

When a coke oven is built, burnable spacers are placed between the bricks in the oven crown to allow for brick expansion. Once the oven is heated, the spacers burn away and the bricks expand due to thermal expansion. However, the ovens are typically never allowed to drop below the thermally-volume-stable temperature (i.e., the temperature above which silica is generally volume-stable and does not expand or contract). If the bricks drop below this temperature, the bricks start to contract. Since the spacers have burned out, a traditional crown can contract up to several inches upon cooling. This is potentially enough movement for the crown bricks to start to shift and potentially collapse. Therefore, enough heat must be maintained in the ovens to keep the bricks above the thermally-volume-stable temperature. However, the thermally-volume-stable temperature is too hot for workers to comfortably enter the coke ovens. Accordingly, there is a need for an improved system that allows workers to comfortably enter a coke oven without requiring that the coke oven be cooled below the thermally-volume-stable temperature.

DETAILED DESCRIPTION

Several embodiments of the present technology are directed to systems and apparatuses used to repair coke ovens while the coke ovens are hot. For example, the present technology can include an insulated enclosure movable between a compact configuration and an expanded configuration in a horizontal non-heat recovery or a heat recovery coke oven, but is not limited to these applications and can be applied in other similar applications. The insulated enclosure can be placed within a coke oven in the compact configuration and expanded into the expanded position so that workers can stand and maneuver within the enclosure. The insulated enclosure can include removable insulated panels positioned around the circumference of the enclosure that insulate the interior of the enclosure from the heated oven sidewalls, floor, and/or crown. The insulated panels can be removable to allow the workers to access portions of the coke oven and clean or repair damaged portions. The insulated enclosure can be modular to allow the enclosure to be adapted to differently sized ovens. This approach can allow the coke oven to be repaired without cooling the coke oven, which can require the coke oven to be unused for an extended time period and/or can often result in the bricks that form the coke oven cracking or shifting out of position as they cool. Accordingly, the insulated enclosure can shield the workers from the high temperatures given off by the coke oven so that the coke oven can remain at an elevated temperature while the workers repair the oven. In accordance with further embodiments, the insulated enclosure allows workers to quickly access the interior of an oven between operation cycles.

Specific details of several embodiments of the disclosed technology are described below with reference to particular, representative configuration. The disclosed technology can be practiced in accordance with ovens, coke manufacturing facilities, and insulation and heat shielding structures having other suitable configurations. Specific details describing structures or processes that are well-known and often associated with coke ovens and heat shields but that can unnecessarily obscure some significant aspects of the presently disclosed technology, are not set forth in the following description for clarity. Moreover, although the following disclosure sets forth some embodiments of the different aspects of the disclosed technology, some embodiments of the technology can have configurations and/or components different than those described in this section. As such, the present technology can include some embodiments with additional elements and/or without several of the elements described below with reference to FIGS. 1-6.

Figure 1:
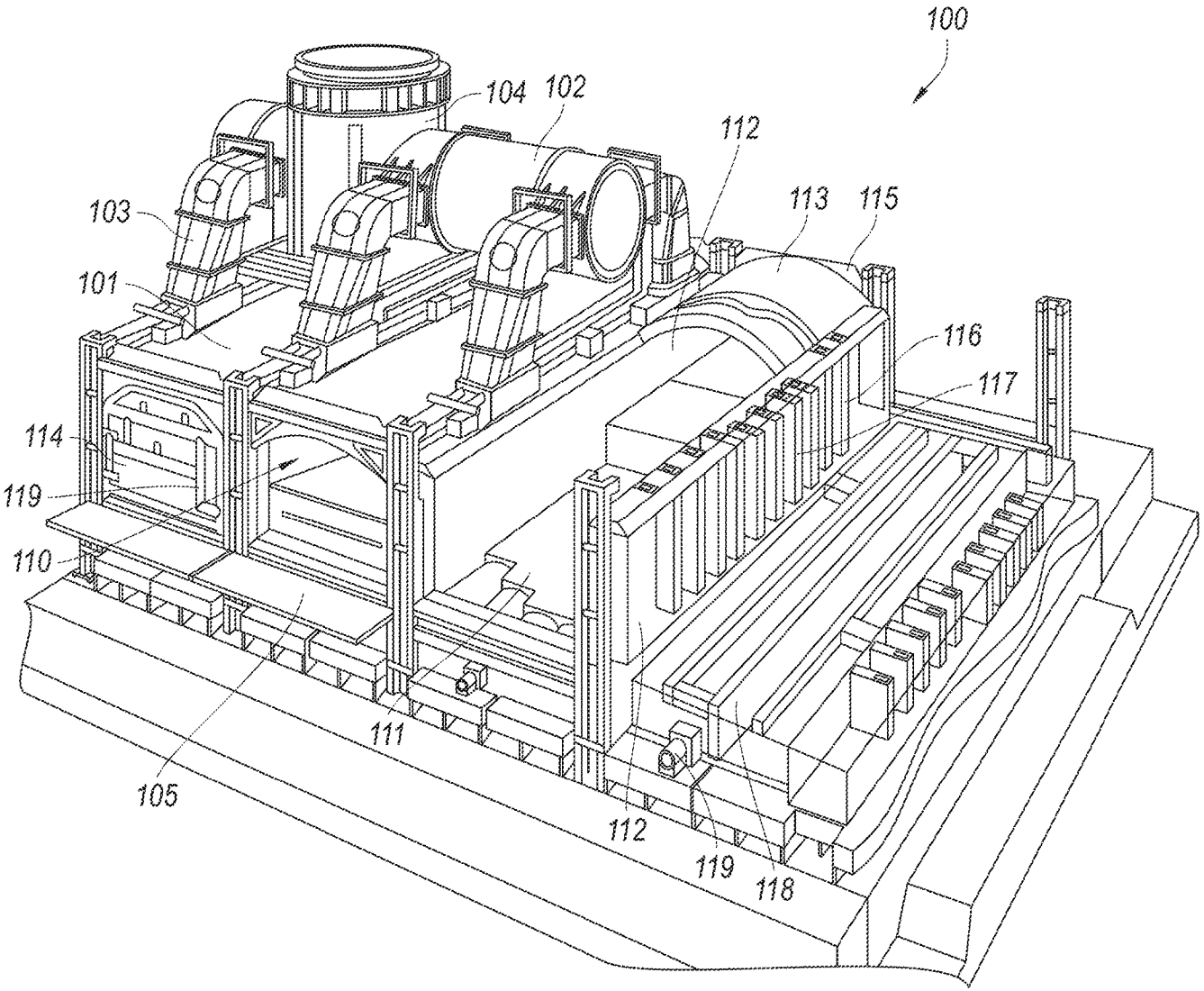
FIG. 1 is an isometric, partial cut-away view of a portion of a horizontal heat recovery/non-recovery coke plant configured in accordance with embodiments of the present technology.

Referring to FIG. 1, a coke plant 100 is illustrated which produces coke from coal in a reducing environment. In general, the coke plant 100 comprises at least one oven 101, along with heat recovery steam generators and an air quality control system (e.g. an exhaust or flue gas desulfurization system) both of which are positioned fluidly downstream from the ovens and both of which are fluidly connected to the ovens by suitable ducts. According to aspects of the disclosure, the coke plant can include a heat recovery or a non-heat recovery coke oven, or a horizontal heat recovery or horizontal non-recovery coke oven. The coke plant 100 preferably includes a plurality of ovens 101 and a common tunnel 102 that is fluidly connected to each of the ovens 101 with uptake ducts 103. A cooled gas duct transports the cooled gas from the heat recovery steam generators to the flue gas desulfurization system. Fluidly connected and further downstream are a baghouse for collecting particulates, at least one draft fan for controlling air pressure within the system, and a main gas stack for exhausting cooled, treated exhaust to the environment. Steam lines interconnect the heat recovery steam generators and a cogeneration plant so that the recovered heat can be utilized. The coke plant 100 can also be fluidly connected to a bypass exhaust stack 104 that can be used to vent hot exhaust gasses to the atmosphere in emergency situations.

FIG. 1 illustrates four ovens 101 with sections cut away for clarity. Each oven 101 comprises an oven chamber 110 preferably defined by a floor 111, a front door 114, a rear door 115 preferably opposite the front door 114, two sidewalls 112 extending upwardly from the floor 111 intermediate the front 114 and rear 115 doors, and a crown 113 which forms the top surface of the oven chamber 110. Controlling air flow and pressure inside the oven 101 can be critical to the efficient operation of the coking cycle and therefore the oven 101 includes one or more air inlets 119 that allow air into the oven 101. Each air inlet 119 includes an air damper which can be positioned at any number of positions between fully open and fully closed to vary the amount of primary air flow into the oven 101. In the illustrated embodiment, the oven 101 includes an air inlet 119 coupled to the front door 114, which is configured to control air flow into the oven chamber 110, and an air inlet 119 coupled to a sole flue 118 positioned beneath the floor 111 of the oven 101. Alternatively, the one or more air inlets 119 are formed through the crown 113 and/or in the uptake ducts 103. In operation, volatile gases emitted from the coal positioned inside the oven chamber 110 collect in the crown 113 and are drawn downstream in the overall system into downcomer channels 117 formed in one or both sidewalls 112. The downcomer channels 117 fluidly connect the oven chamber 110 with the sole flue 118 positioned. The sole flue 118 forms a circuitous path beneath the floor 111 and volatile gases emitted from the coal can be combusted in the sole flue 118, thereby generating heat to support the reduction of coal into coke. The downcomer channels 117 are fluidly connected to uptake channels 116 formed in one or both sidewalls 112. The air inlet 119 coupled to the sole flue 118 can fluidly connect the sole flue 118 to the atmosphere and can be used to control combustion within the sole flue. The oven 101 can also include a platform 105 adjacent to the front door 114 that a worker can stand and walk on to access the front door and the oven chamber 110.

In operation, coke is produced in the ovens 101 by first loading coal into the oven chamber 110, heating the coal in an oxygen depleted environment, driving off the volatile fraction of coal and then oxidizing the volatiles within the oven 101 to capture and utilize the heat given off. The coal volatiles are oxidized within the ovens over a 48-hour coking cycle and release heat to regeneratively drive the carbonization of the coal to coke. The coking cycle begins when the front door 114 is opened and coal is charged onto the floor 111. The coal on the floor 111 is known as the coal bed. Heat from the oven (due to the previous coking cycle) starts the carbonization cycle. Preferably, no additional fuel other than that produced by the coking process is used. Roughly half of the total heat transfer to the coal bed is radiated down onto the top surface of the coal bed from the luminous flame and radiant oven crown 113. The remaining half of the heat is transferred to the coal bed by conduction from the floor 111 which is convectively heated from the volatilization of gases in the sole flue 118. In this way, a carbonization process "wave" of plastic flow of the coal particles and formation of high strength cohesive coke proceeds from both the top and bottom boundaries of the coal bed at the same rate, preferably meeting at the center of the coal bed after about 45-48 hours.

The floor 111, the sidewalls 112, and the crown 113 are typically formed from ceramic bricks (e.g., refractory bricks) capable of withstanding high temperatures and that typically retain heat for an extended period. In some embodiments, the bricks be formed from a ceramic material that includes silica and/or alumina. The sidewalls 112 can include bricks stacked together in an alternating arrangement and the crown 113 can include bricks arranged in an arch. However, these bricks can be brittle and can sometimes break. For example, striking the bricks (e.g., with a forklift or other machinery, with a tool, etc.) can cause the bricks to fracture. In addition, the bricks can sometimes break due to internal stresses caused by thermal expansion and contraction as the bricks are repeatedly heated and cooled over a prolonged period. The bricks can also break due to differences in temperature between opposing sides of the brick, which can result in internal stresses forming due to the temperature gradient. For example, in the illustrated embodiment, some of the bricks that form the sidewalls 112 can be positioned between the oven chamber 110 and the uptake and downcomer channels 116 and 117 and the differences in temperature between the air in the oven chamber 110 and the air in the uptake and downcomer channels 116 and 117 can sometimes result in these bricks breaking.

Figure 2:
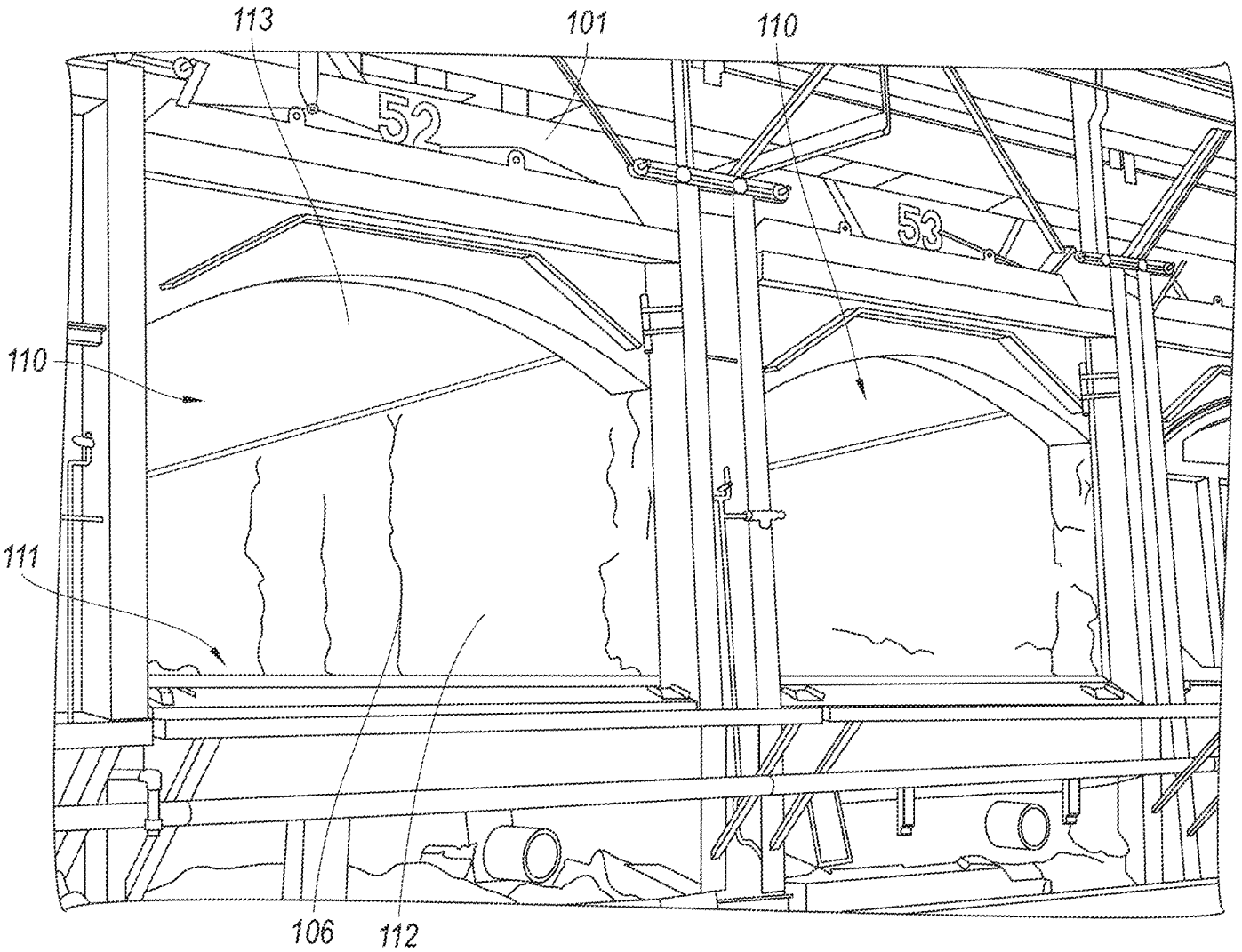
FIG. 2 is an isometric view of two ovens having the front doors removed.

FIG. 2 is an isometric view of two ovens 101 having the front doors removed and having a plurality of cracks 106 formed in the sidewalls 112. In the illustrated embodiment, the cracks 106 are generally vertical and extend completely through the thickness of the sidewalls 112 such that the uptake channels and the downcomer channels are in fluid communication with the oven chamber 110 and air can pass through the cracks 106. In other embodiments, the cracks 106 may not extend completely through the sidewalls 112, can be formed in the crown 113, and/or can be formed in the floor 111. The presence of these cracks 106 can affect the temperature within the oven chamber 110 as well as the airflow regulating abilities of the ovens 101, which can affect the efficiency of the oven 101 and can reduce the ability of the ovens 101 to convert coal into coke. Accordingly, to maintain the operating efficiency and effectiveness of the oven 101, the oven 101 can be repaired by replacing the broken bricks.

Figure 3A:
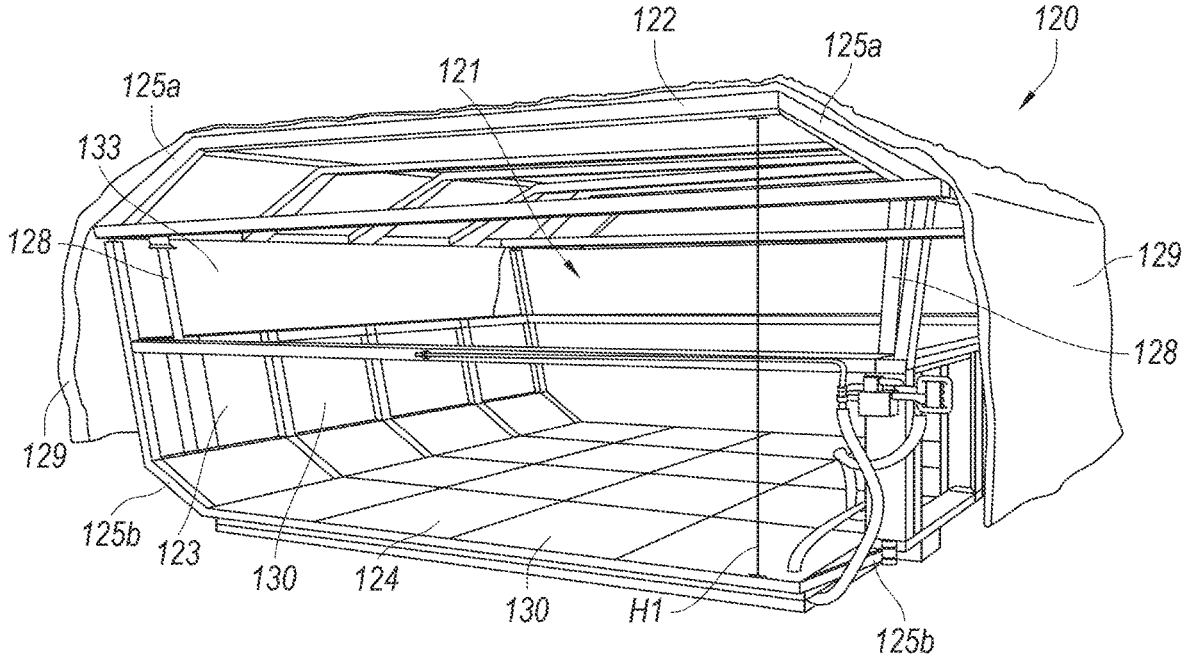
FIG. 3A is an isometric view of a insulated enclosure in an expanded configuration that can be inserted into the oven chamber of FIG. 2 and configured in accordance with embodiments of the present technology.

However, the oven chamber 110 is typically too hot for workers to comfortably work and additional insulation and cooling systems are required. In representative embodiments of the present technology, a insulated enclosure that includes insulation can be positioned within the oven chamber 110 to allow workers to comfortably enter the oven chamber 110 and access the cracks 106 and any other portions of the oven 101 that require cleaning, repair or maintenance. The insulation can prevent heat emitted by the bricks from entering the enclosure so that the temperature within the enclosure can remain at a sufficiently low temperature for the workers to comfortably work and repair the oven 101 without requiring that the oven 101 completely cool down ambient temperatures. FIG. 3A shows an elevation view of a insulated enclosure 120. The insulated enclosure 120 includes an interior area 121 defined by a ceiling portion 122, a floor portion 124, and opposing side portions 123. The ceiling portion 122 can include first angled portions 125*a* and the floor portion 124 can include second angled portions 125*b*. The insulated enclosure 120 can be formed from a frame 126 and a plurality of panels 130 removably coupled to the frame 126. The panels 130 can be positioned against and secured to the frame 126 to form the ceiling portion 122, floor portion 124, and the side portions 123 and each of the panels 130 can include insulation configured to prevent heat given off by the oven 101 from entering the interior area 121.

Each of the panels 130 can include an insulation portion 131 and a backing portion 132 coupled to the insulation portion and the panels 130 can be coupled to the frame 126 such that the insulation portion 131 faces away from the interior area 121 (i.e., towards the sidewalls 112, the crown 113, and the floor 111). The backing portion 132 can be formed from metal and can include handles that workers can use to control and maneuver the panel 130. In some embodiments, the insulation portion 131 can be formed from a high-temperature insulation wool (HTIW), ceramic blanket material, Kaowool, or the like. In other embodiments, the insulation portion 131 includes rigid insulation made from ceramic tiles. In either of these embodiments, the insulation portion 131 is sized and shaped to generally conform to the shape of the of the backing portion 132.

When the insulated enclosure 120 is in the expanded configuration, the side portions 123 can include a gap 133 between the top edges of the panels 130 and the first angled portions 125*a* through which heat from the oven chamber 110 can pass into the interior area 121. To prevent or at least limit the amount of heat that can pass through the gap 133 when the insulated enclosure 120 is in the expanded position, the insulated enclosure 120 can also include insulation 129 that cover the gap 133. The insulation 129 can be formed from a ceramic blanket material coupled to the ceiling portion 122. The insulation 129 can drape over the first angled portions 125*a* and extend past the gap 133 to at least partially cover the panels 130. When a worker needs to access a selected portion of the sidewall 112 that is blocked by the insulation 129, the insulation 129 can be pushed aside or secured out of the way to expose the selected portion of the sidewall 112. In some embodiments, the insulation 129 includes a plurality of strips that each cover a portion of the gap 133. In these embodiments, the strips can be individually manipulated and secured out of the way. In other embodiments, however, the insulation 129 can include a curtain that covers the entire gap 133. The curtain can be movably coupled to a rod attached to the frame 126 such that the curtain can slide along the entire length of the insulated enclosure 120 and can completely cover the gap 133.

In the illustrated embodiment, the first angled portions 125*a* form an angle of approximately 45° with the side portions 123 and the second angled portions 125*b* form an angle of approximately 45° with the side portions 123. In other embodiments, however, the first and second angled portions 125*a* and 125*b* can form some different angles with the side portions 123. For example, in some embodiments, the first and second angled portions 125*a* and 125*b* can form an angle less than 45° with the side portions 123. In still other embodiments, the insulated enclosure 120 can be formed such that the first angled portions 125*a* can form a different angle with the side portions 123 than the second angled portions 125*b*. In general, the insulated enclosure 120 can be formed such that the angled portions 125*a* and 125*b* conform to the size and shape of the oven chamber.

Figure 3B:
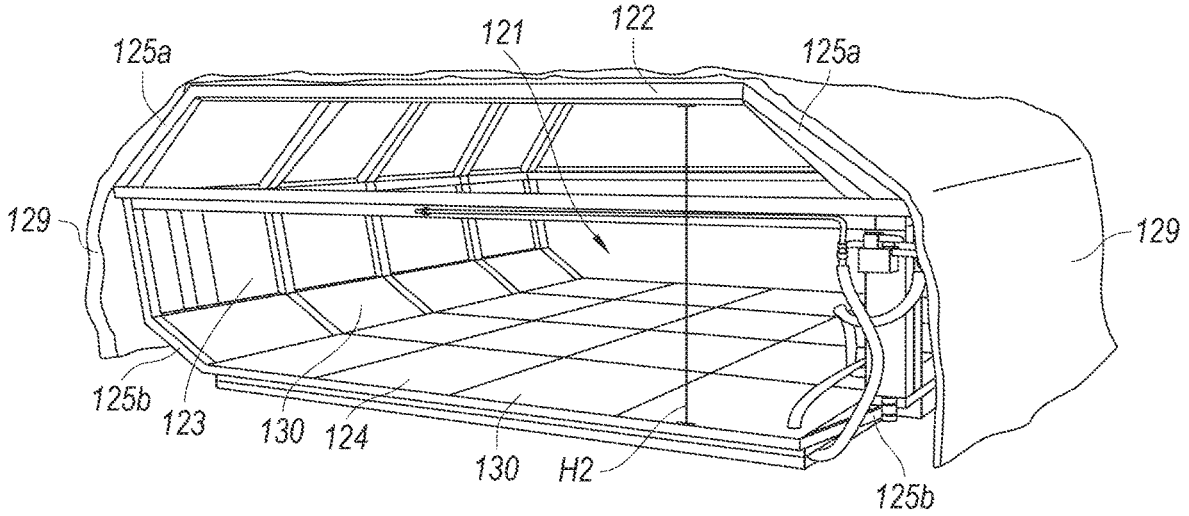
FIG. 3B is an isometric view of the insulated enclosure of FIG. 3A in a compact configuration and configured in accordance with embodiments of the present technology.

The insulated enclosure 120 can be movable between a first, expanded configuration and a second, compact configuration. In the embodiment shown in FIG. 3A, the insulated enclosure 120 is in the expanded configuration. In this configuration, the interior area 121 can have a height H1 sufficiently large enough for workers to comfortably stand and maneuver within the insulated enclosure 120. However, inserting the insulated enclosure 120 into the oven chamber 110 in the second, compact configuration allows the insulated enclosure to be placed without accidentally striking the crown and/or sidewalls of the oven chamber. Accordingly, the insulated enclosure 120 can be in the compact configuration when the insulated enclosure 120 is inserted into the oven chamber and expanded in a desired position. FIG. 3B shows the insulated enclosure 120 in the compact configuration. In this configuration, the interior area 121 can have a height H2 that is less than the height H1. In this way, the risk of striking the crown and/or the sidewalls of the oven chamber when inserting the insulated enclosure into the oven chamber can be reduced.

To facilitate moving the insulated enclosure 120 between the first, expanded and the second, compact configuration, the insulated enclosure 120 can include one or more adjustable jacks 128 interactively coupled to the frame 126. The jacks 128 can be movable between an elongated position and a shortened position. Specifically, the one or more jacks can be in the elongated position when the insulated enclosure 120 is in the expanded configuration and the shortened position when the insulated enclosure 120 is in the compact configuration. To move the insulated enclosure 120 to the expanded configuration, the jacks 128 can move to the elongated position by lifting the ceiling portion 122 away from the floor portion 124, thereby increasing the height of the interior area 121 to the first height H1. Conversely, to move the insulated enclosure 120 to the compact configuration, the jacks 128 can move to the shortened position by lowering the ceiling portion 122 towards the floor portion 124, thereby decreasing the height of the interior 121 area to the second height H2. In the illustrated embodiments, the insulated enclosure 120 includes four of the jacks 128 positioned at the four corners of the insulated enclosure 120. In other embodiments, however, the insulated enclosure can include a single jack 128 positioned at the center of the insulated enclosure. In some embodiments, the jacks 128 can be hydraulic or pneumatic jacks that utilize a fluid to move the jack 128 between the elongated position and the shortened position. In other embodiments, the jacks 128 can be mechanical jacks that require a worker to move the jack 128 between the elongated position and the shortened position using a handle or a lever. When the insulated enclosure 120 is in either the expanded configuration or the compact configuration, a locking mechanism can be used to secure the ceiling portion in the selected configuration.

In the illustrated embodiments, moving the insulated enclosure 120 between the expanded configuration and the compact configuration causes both the height of the insulated enclosure 120 and the distance between the roof portion 122 and the crown to change without affecting the width of the insulated enclosure 120 does not change or the distance between the side portions 123 and the sidewalls. In other embodiments, however, moving the insulated enclosure 120 between the expanded configuration and the compact configuration can cause both the width of the insulated enclosure 120 and the distance between the side portions 123 and the sidewalls to change. In these embodiments, the insulated enclosure 120 can include one or more horizontally-oriented jacks 128 coupled to the frame 126 and used to slide the two side portions 123, thereby increasing the width of the insulated enclosure 120.

The insulated enclosure 120 can also include support rails 127 integrally coupled to the frame 126 adjacent to the floor portion 124. The support rails 127 can be formed from elongated pieces of metal having a flattened bottom surface configured to be in contact with the floor of the oven chamber. In this way, when the insulated enclosure 120 is inserted into the oven chamber, the insulated enclosure 120 can slide along the floor on the support rails 127. In other embodiments, however, the insulated enclosure 120 can include wheels, continuous tracks (i.e., tank treads), or another mechanism to facilitate moving the insulated enclosure 120 along the floor of the oven chamber.

When the insulated enclosure 120 is positioned at the entrance of the oven chamber 110, workers can use the insulated enclosure 120 to access and work on portions of the oven chamber 110 near the entrance. However, the oven chamber 110 can be longer than the insulated enclosure 120 and accessing selected portions of the oven chamber 110 far from the entrance can require the insulated enclosure 120 to be positioned away from the entrance. To allow the workers to comfortably access and work on these selected portions, multiple of the insulated enclosures 120 can be inserted into the oven chamber 110 adjacent to each other and coupled together.

Figure 4:
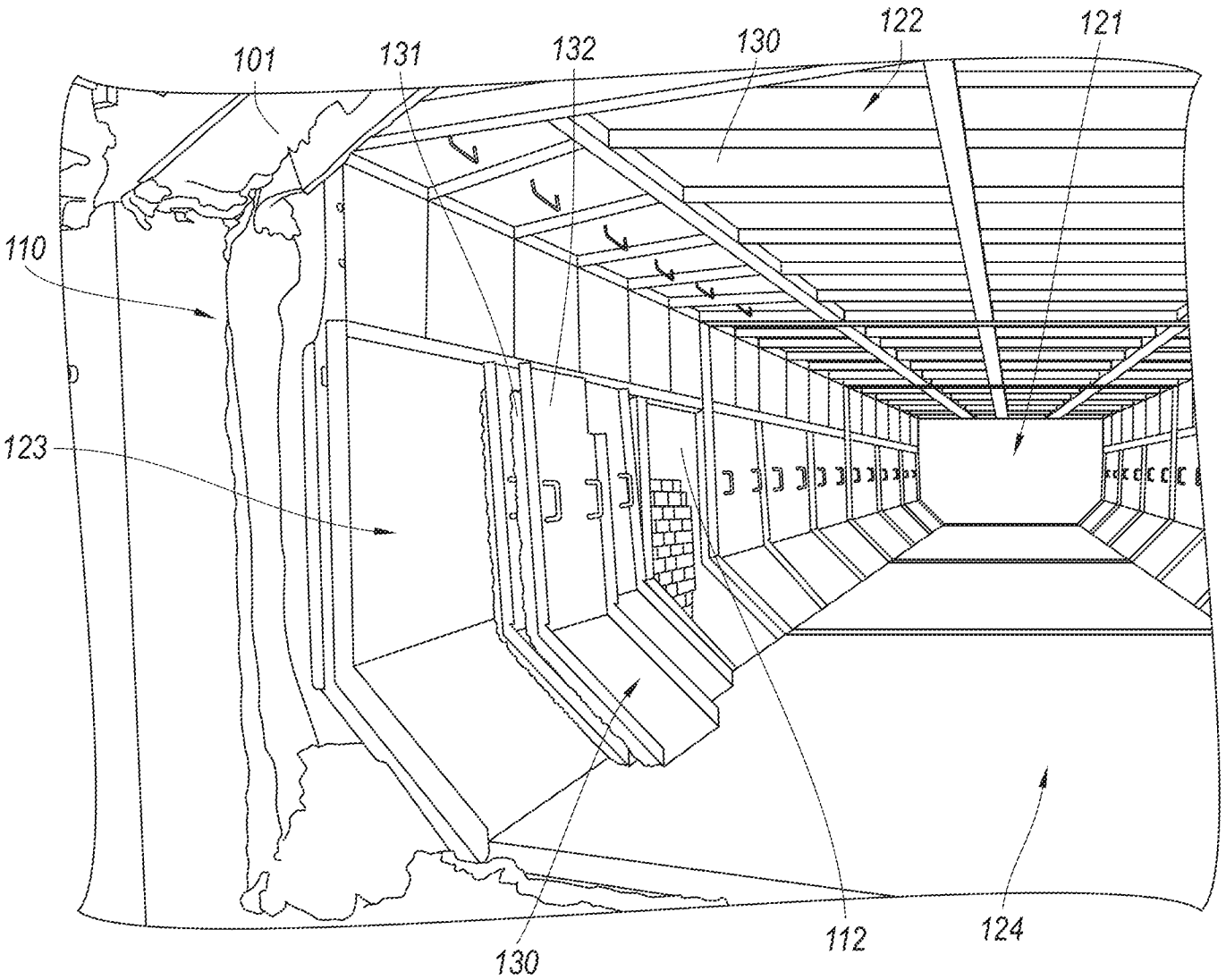
FIG. 4 is an isometric view of multiple of the insulated enclosure shown in FIGS. 3A and 3B inserted into an oven chamber and coupled together, in accordance with embodiments of the present technology.

FIG. 4 shows an isometric view of a plurality of insulated enclosures 120 coupled together and positioned within the oven chamber 110. In the illustrated embodiment, the plurality of insulated enclosures 120 extend completely through the oven chamber 110 from the front side to the back side. With this arrangement, the multiple insulated enclosures 120 can form an elongated interior area 121 having a length substantially equal to the length of the oven chamber 110. Further, the front and rear doors (i.e., the front door 114 and the rear door 115 shown in FIG. 1) can be opened and/or removed so that air from outside of the oven 101 can flow through the elongated interior area 121 to provide additional cooling to the workers.

In other embodiments, however, the multiple insulated enclosures 120 may only extend part of the way into the oven chamber 110 such that such that portions of the oven chamber 110 near the entrance are covered by the insulated enclosures 120 while portions further from the entrance are not. However, the portions of the oven chamber 110 further from the entrance are still at an elevated temperature and give off heat. Accordingly, the insulated enclosure 120 furthest from the entrance can have an insulated wall portion that forms a bulkhead to reduce the amount of heat from entering the interior area 121. In some embodiments, the wall portion can include removable panels 130 or can include a non-removable insulated structure. In other embodiments, the insulated wall portion can be formed from soft and flexible insulation coupled to the ceiling portion 122 that hangs over the end of the insulated enclosure 120.

To couple the multiple insulated enclosures 120 together, each of the insulated enclosures 120 can include alignment mechanisms configured to mate with the alignment mechanisms on an adjacent insulated enclosure 120. For example, in some embodiments, the insulated enclosures 120 can include guides that can help arrange and position the insulated enclosures 120. Once aligned, the insulated enclosures 120 can be coupled together using bolts, clamps, or a different connection apparatus.

In the illustrated embodiment, one of the panels 130 that forms one of the side portions 123 of the nearest insulated enclosure 120 is decoupled from the frame 126, thereby exposing the sidewall 112 and allowing workers within the insulated enclosure 120 to access and interact with the bricks that form the sidewall 112. Accordingly, decoupling the panels 130 that form the side portions 123 from the frame 126 allows the workers to repair the sidewalls 112 of the oven chamber 110. Similarly, decoupling the panels 130 that forms the floor portion 124 from the frame 126 can expose the floor 111 of the oven chamber 110 so that workers can repair the floor 111. For example, during operation of the oven 101, hardened coke can stick to the bricks that form the floor 111 and removing the coke from the oven chamber 110 can sometimes cause portions of these bricks to break off and be removed with the coke, which can result in the floor 111 being uneven. Accordingly, decoupling the panels 130 that form the floor portion 124 from the frame 126 can expose the floor 111 and allow workers to access the bricks so that the floor 111 can be repaired.

The insulated enclosure 120 can allow workers to repair the oven chamber 110 using any selected repair technique. For example, workers can selectively remove damaged or misaligned bricks from the exposed portions of the oven chamber 110 and replace the removed bricks with new bricks. The workers can also be able to repair the oven chamber without removing any bricks. For example, the workers can cast refractory over broken or misaligned bricks in the floor 111 to level the floor 111 in lieu of replacing the broken bricks as the lowered temperature within the oven chamber 110 can improve the casting ability and performance of the refractory. Other repairing techniques, such as silica welding and shotcrete can also be used to repair the oven chamber 110.

The insulated enclosures 120 can include a transportation system that transports bricks removed from the floor 111, sidewalls 112, and/or crown 113 out of the oven chamber 110. In some embodiments, the transportation system can include a conveyor belt that extends into the interior area 121. Workers can place the bricks onto the conveyor belt and the conveyor belt can carry the bricks out of the oven chamber 110. The conveyor belt apparatus can also be used to carry bricks and/or other supplies into the insulated enclosures 120 for the workers to use while inspecting or repairing the oven chamber 110.

The insulated enclosure 120 can also include additional cooling and insulating apparatuses configured to help regulate temperature within the interior area 121. For example, the insulated enclosure 120 can include fans that circulate cool air from outside of the oven 101 into the interior area 121 and/or blow warm air from inside the interior area 121 to outside of the insulated enclosure 120. In some embodiments, these fans can be positioned within the insulated enclosure 120 or can be positioned outside of the insulated enclosure 120. In embodiments for which a plurality of the insulated enclosures 120 are coupled together and extend through the oven chamber 110, the fans can blow air from one end of the oven chamber 110 to the other. The fans can also regulate and control air pressure within the interior area 121. In other embodiments, the insulated enclosure 120 can include a pipe that brings cool air into the interior area 121 from outside of the oven chamber 110. The pipe can be insulated and can be coupled to an air compressor or a fan to push the cool air through the pipe. Further, in some embodiments, the insulated enclosure 120 can include a fluid membrane coupled to the floor portion 124. The fluid membrane can be coupled to a fluid source and a fluid pump can circulate the fluid through the fluid membrane to cool the feet of the the workers on or near the fluid membrane.

As previously discussed, the insulated enclosure 120 can be used to inspect and repair the oven chamber 110 when the oven 101 is not charged but without requiring that the oven chamber 110 be completely cooled. Accordingly, the bricks can be still be hot when the insulated enclosure 120 is inserted into the oven chamber 110. For example, in some embodiments, the bricks can be over 2000° F. when the oven 101 is charged and can be approximately 1000° F. when the oven is not charged. However, if the oven is uncharged for too long and the bricks cool below the thermally-volume-stable temperature of the ceramic material, the bricks can shrink, which can cause the bricks to shift out of alignment and the oven chamber 110 to require additional repairs. For example, the bricks that form the crown 113 can shrink and fall towards the insulated enclosure 120 if they cool below the thermally-volume-stable temperature, which can cause the crown 113 to collapse. Accordingly, the ceiling portion 122 can provide a safety function by preventing the bricks from falling onto the workers within the insulated enclosure 120.

To help prevent the bricks from cooling below the thermally-volume-stable temperature, in some embodiments, the insulated enclosure 120 can include one or more external heating apparatuses coupled to the exterior surface of the insulated enclosure 120 and positioned to direct heat towards the crown 113, the sidewalls 112, and the floor 111. In some of these embodiments, the external heating apparatus can be an electrical heating apparatus. In other embodiments, the external heating apparatus can include one or more chemical burners. The external heating apparatuses can direct heat towards the bricks to keep the bricks above the thermally-volume-stable temperature so that that they do not shrink while the oven chamber 110 is being repaired. Accordingly, the external heating apparatuses can help to allow the workers to work on the oven chamber 110 for a prolonged period without the bricks shrinking. In other embodiments, however, the insulated enclosure 120 does not include external heating apparatuses. Instead, the temperature of the oven chamber 110 is monitored when the insulated enclosure 120 is inserted into the oven chamber 110 so that the insulated enclosure 120 can be removed when the temperature approaches the thermally-volume-stable temperature. Heat can be added through sole flue 118 from an adjacent oven to return the oven being repaired to a sufficient temperature to maintain brick stability. Alternatively, the insulated enclosure 120 may be removed, the oven can be turned heated by any of the above mentioned means until the temperature within the oven chamber reaches a selected temperature. In this way, the insulated enclosure 120 can be in the oven chamber 110 for only a shortened period so that the bricks can be prevented from cooling below the thermally-volume-stable temperature and shrinking. Once the oven chamber 110 reaches the selected temperature, the insulated enclosure 120 can be reinserted into the oven chamber 110 so that further repairs can be made. This process can be repeated until all the necessary repairs have been.

Figure 5:
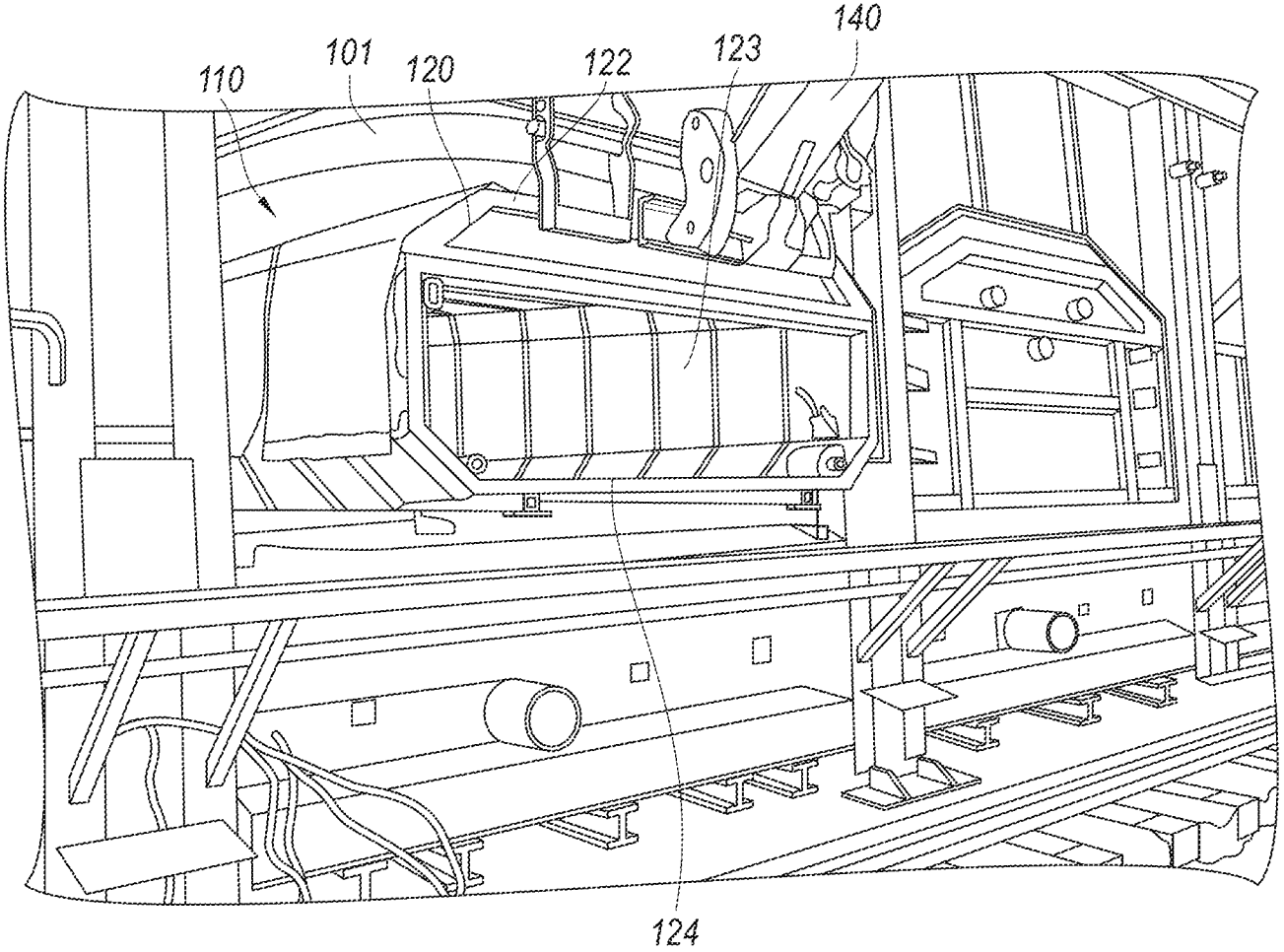
FIG. 5 is an isometric view of the insulated enclosure shown in FIGS. 3A and 3B being inserted into an oven chamber.

The insulated enclosure 120 can be inserted into the oven chamber 110 using a positioning apparatus. In some embodiments, the positioning apparatus includes a forklift. FIG. 5 shows an isometric view of the insulated enclosure 120 being inserted into the oven chamber 110 using a forklift 140. In the illustrated embodiment, the forklift 140 lifts the insulated enclosure by engaging the ceiling portion 122 of the insulated enclosure 120. In other embodiments, the forklift 140 can engage with a different portion of the insulated enclosure 120 to support the weight of the insulated enclosure 120. For example, in some embodiments, the forklift 140 can engage with the floor portion 124 or with mounting points positioned along the side portions 123. In other embodiments, however, the insulated enclosure 120 can be inserted into the oven chamber 110 using a different positioning apparatus. For example, in some embodiments, construction equipment, such as an excavator, can be used to lift and position the insulated enclosure 120. In still other embodiments, the positioning apparatus can include a moving structure (e.g., a railcar), and a pushing mechanism (e.g., a ram). The insulated enclosure 120 can be positioned on the moving structure and can be pushed into the oven chamber 110 with the pushing mechanism when the moving structure is aligned with the entrance to the oven chamber 110.

The positioning apparatus can also be used to remove the insulated enclosure 120 from the oven chamber 110. For example, in embodiments for which the forklift 140 is used to insert the insulated enclosure 120 into the oven chamber 110, the forklift 140 can lift and pull the insulated enclosure 120 out of the oven chamber 110. Similarly, the pushing mechanism can be used to pull the insulated enclosure 120 out of the oven chamber 110. The insulated enclosure 120 can include an attachment mechanism coupled to the frame and the attachment mechanism can be releasably couplable to a second attachment mechanism coupled to the pushing mechanism and the pushing mechanism can be used to pull the insulated enclosure 120 out of the oven 101 using the attachment mechanisms. In some embodiments, the attachment mechanisms include collars that interlock with each other to attach the insulated enclosure 120 to the pushing mechanism. In some embodiments, the attachment mechanisms can also be used to push the insulated enclosure 120 into the oven chamber.

Figure 6:
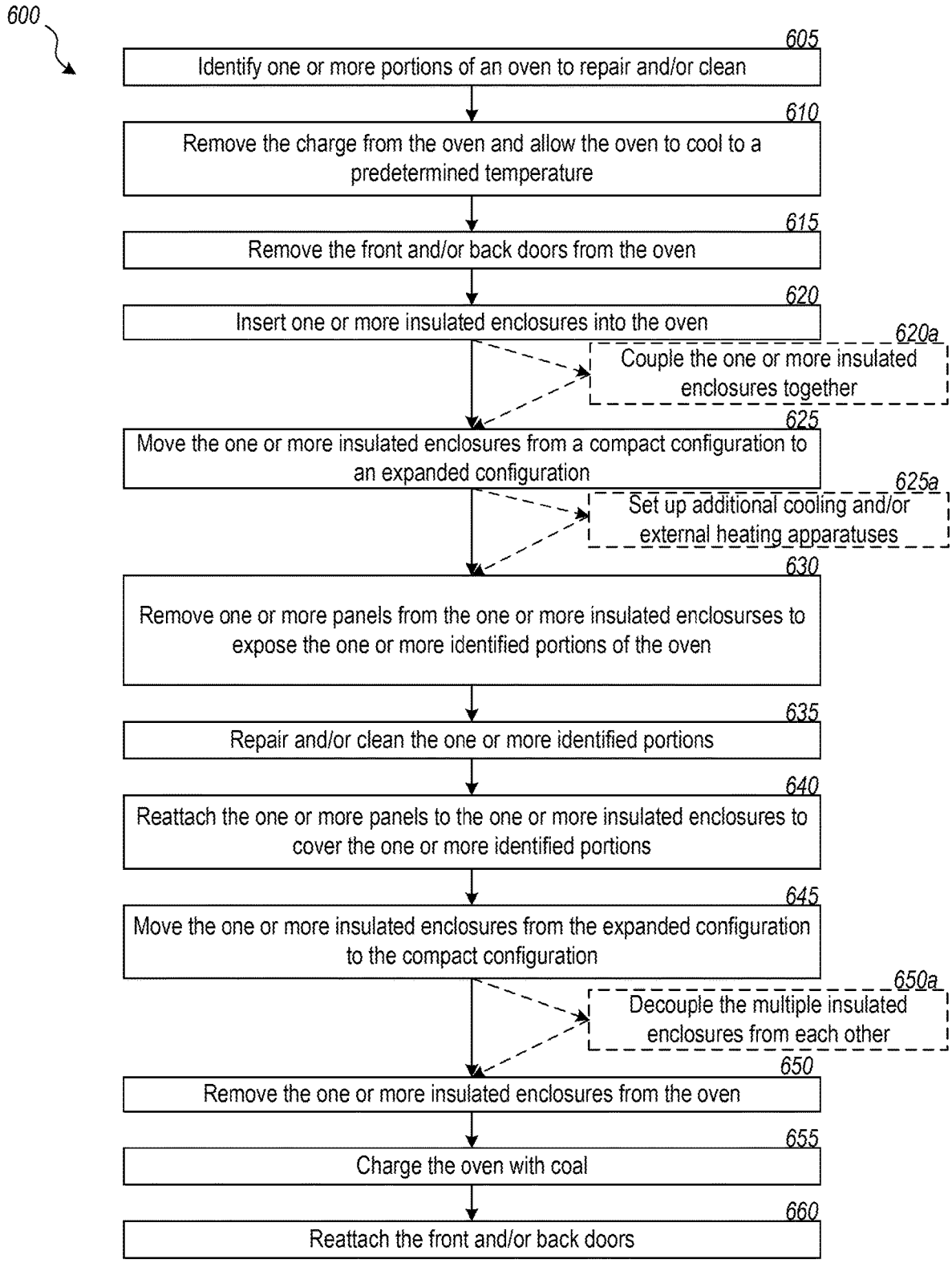
FIG. 6 is a method of repairing an oven chamber using the insulated enclosure, in accordance with embodiments of the present technology.

FIG. 6 shows a method 600 of using the insulated enclosure to repair an oven chamber for a coke oven without the temperature in the oven chamber falling below an elevated temperature. At step 605, the oven chamber is inspected for any portions that need repair. These portions can include defects that can be visually diagnosed, such as cracks or broken bricks in the floor portion, sidewalls, and/or crown or bricks that have shifted out of alignment. The portions can also include older bricks that do not appear to be broken or defective but that are old and need to be replaced for newer bricks.

At step 610, the front and/or back door of the oven chamber is removed. If the identified portions of the oven chamber are near the front of the oven chamber, only the front door can be removed, while if the identified portions of the oven chamber are near the back of the oven chamber, only the back door can be removed. However, if the identified portions are in the middle of the oven chamber and/or are near both the front and back of the oven chamber, both the front and back doors can be removed. In some embodiments, the front and/or back doors can be removed before the oven chamber reaches the predetermined temperature to increase the rate of cooling within the oven chamber.

At step 615, the oven charge is removed and the oven may be allowed to cool to a predetermined temperature. Some coke ovens can operate at temperatures greater than 2000° F., requiring the insulated enclosure to protect workers from heat. Accordingly, the ovens need to be turned off so that the oven chambers can cool before the workers can enter the oven chamber. However, coke ovens typically do not use a supplemental heat source to form the coke and instead rely upon the heat produced by the coal as it burns to heat the oven chamber. As a result, cooling a coke oven often includes removing the coke from the oven chamber without adding new coal. After the charge is removed from the coke oven, the oven chamber can be allowed to cool until the temperature reaches a predetermined temperature. In some embodiments, the predetermined temperature can be similar to the thermally-volume-stable temperature of the bricks so that the bricks do not substantially shrink. For example, in embodiments where the bricks are formed from silica, the oven chamber can be allowed to cool until the temperature reaches approximately 1200° F. In embodiments where the bricks are formed from alumina, however, the oven chamber can be allowed to cool to a temperature below 1200° F. In general, the predetermined temperature can be selected based on the type of oven and the composition of the bricks so that the bricks do not substantially shrink and deform as the oven chamber cools.

At step 620, one or more insulated enclosures can be inserted into the oven chamber. The one or more insulated enclosures can include removable insulated panels coupled to a frame and can be inserted into the oven chamber using machinery (e.g., a forklift or a pushing mechanism), until the one or more insulated enclosures are positioned over the one or more identified portions. At step 620*a*, the insulated enclosures can include coupling mechanisms and can be coupled to each other using the coupling mechanisms to form a passageway from the front and/or back entrance of the oven chamber to the identified portion.

The insulated enclosures can be movable between a compact configuration and an expanded configuration and can be inserted into the oven chamber when in the compact configuration. At step 625, the insulated enclosures can be moved from the compact configuration to the expanded configuration using one or more jacks. In some embodiments, moving the insulated enclosures to the expanded configuration can increase the height of the insulated enclosures so that the ceiling portion of the insulated enclosure is closer to the crown of the oven chamber and so that workers can more comfortably stand working in the insulated enclosures. In other embodiments, moving the insulated enclosures to the expanded configuration can increase the width of the insulated enclosures so that the side portions of the insulated enclosure are closer to the sidewalls of the oven chamber. In still other embodiments, moving the insulated enclosure to the expanded configuration can increase both the height and the width of the insulated enclosure.

At step 625*a*, the insulated enclosures can optionally include cooling apparatuses used to provide additional cooling to the workers within the insulated enclosures and external heating apparatuses coupled to the exterior of the insulated enclosures to heat the bricks so that the bricks do not cool and shrink while the oven chamber is being repaired. In some embodiments, the cooling apparatuses can include fans, fluid membranes that circulate cooled fluid throughout the insulated enclosures, insulated pipes that can bring in cool air from outside of the oven, etc., while the external heating apparatuses include electrical heaters and/or chemical burners. According to alternative embodiments, heat from adjacent operational ovens can be transferred to the oven being repaired or cleaned through the sole flue. Once the insulated enclosure is in the expanded configuration, the cooling apparatuses and the external heating apparatuses can be activated.

At step 630, one or more of the insulated removable panels can be detached from the frame to expose the one or more identified portions of the oven. The panels can be arranged along the side portions, the ceiling portions, and the floor portions of the insulated enclosures so that the identified portions that are in the sidewalls, the floor, and/or the crown of the oven chamber can be accessed by workers within the insulated enclosure.

At step 635, the one or more identified portions of the oven chamber are repaired. Repairing the one or more identified portions can include replacing damaged bricks, casting refractory over uneven surfaces in the floor, silica welding bricks together, and/or using shotcrete. Other cleaning and repairing techniques can also be used.

At step 640, after repairing the identified portions, the insulated removable panels are reattached to the frame to cover the now-repaired identified portions.

At step 645, the insulated enclosures can be moved from the expanded configuration to the compact configuration.

At step 650*a*, the insulated enclosures can be optionally be decoupled from each other and removed from the oven chamber (e.g., using the forklift or the pushing mechanism). At step 650, the insulated enclosures can be removed from the oven. In some embodiments, the insulated enclosures can be decoupled from each other before being moved to the compact configuration while in other embodiments, the insulated enclosures can be decoupled from each other after being moved to the compact configuration.

At step 655, the oven can be charged with coal. At step 660, the front and/or back doors are reattached to the oven chamber. In some embodiments, heating the oven can include depositing coal into the oven chamber and closing the doors so that the latent heat within the oven chamber can burn the coal, thus causing the oven to heat back up. In other embodiments, however, an additional heat source or heat from an adjacent oven can be used to heat the oven chamber back up to an elevated temperature.

From the foregoing, it will be appreciated that several embodiments of the disclosed technology have been described herein for purposes of illustration, but that various modifications can be made without deviating from the technology. For example, in some embodiments, the insulated enclosure can be in the expanded configuration or the compact configuration but cannot be movable between the expanded configuration and the compact configuration. The insulated enclosure can be insulated using any suitable type of insulation and can be cooled using any suitable cooling mechanism. More generally, the insulated enclosure can be used in any type of oven or furnace to allow workers to access and repair the oven chamber or furnace.

Certain aspects of the technology described in the context of particular embodiments can be combined or eliminated in other embodiments. For example, the insulated enclosure can be formed without insulation and/or some of the panels cannot be removable. Further, while advantages associated with some embodiments of the disclosed technology have been described herein, configurations with different characteristics can also exhibit such advantages, and not all configurations need necessarily exhibit such advantages to fall within the scope of the technology. Accordingly, the disclosure and associated technology can encompass other arrangements not expressly shown or described herein. The following examples provide further representative descriptions of the present technology:

1. An insulated enclosure having an interior area defined by a floor portion, a ceiling portion, and opposing first and second side portions that extend between the floor portion and the ceiling portion, the insulated enclosure comprising:

a frame portion; and a plurality of panels releasably coupled to the frame portion, wherein— the plurality of panels at least partially define the floor portion, the ceiling portion, and the first and second side portions, individual of the panels comprises an insulation portion and a backing portion coupled to the insulation portion, the insulated enclosure is movable between a first configuration and a second configuration, and the interior area comprises a first height when the insulated enclosure is in the first configuration and a second height less than the first height when the enclosure is in the second configuration.

2. The insulated enclosure of example 1, further comprising a first gap between the ceiling portion and the first side portion and a second gap between the ceiling portion and the second side portion when the insulated enclosure is in the first configuration; and insulation coupled to the ceiling portion that covers the first and second gaps.

3. The insulated enclosure of example 1, further comprising:

at least one jack coupled to the frame portion, wherein the at least one jack is configured to move the insulated enclosure between the first configuration and the second configuration.

4. The insulated enclosure of example 3 wherein the at least one jack comprises a mechanical jack.

5. The insulated enclosure of example 1, further comprising:

a cooling apparatus used to circulate cool air from outside of the insulated enclosure into the interior area.

6. The insulated enclosure of example 1, further comprising:

an external heating apparatus used to produce heat, wherein the external heating apparatus is coupled to an exterior surface of the insulated enclosure and is positioned to direct the produced heat away from the interior area.

7. The insulated enclosure of example 1 wherein the interior area comprises a first width when the insulated enclosure is in the first configuration and a second width less than the second width when the insulated enclosure is in the second configuration.

8. The insulated enclosure of example 1 wherein the insulation portion comprises a ceramic material and the backing portion comprises metal.

9. A method of repairing a coke oven having an oven chamber defined by a floor, a crown, and sidewalls that extend between the floor and the crown and wherein the coke oven comprises a plurality of bricks that form the floor, the crown, and the sidewalls, the method comprising:

inserting a insulated enclosure into the oven chamber, wherein— the insulated enclosure includes a plurality of panels removably coupled to a frame portion, the insulated enclosure is movable between a first configuration and a second configuration, inserting the insulated enclosure into the oven chamber comprises inserting the insulated enclosure into the oven chamber when the insulated enclosure is in the first configuration;

moving the insulated enclosure from the first configuration to the second configuration;

detaching at least one of the panels from the frame portion to expose at least one of the floor, the crown, and the sidewalls;

repairing at least one of the bricks;

reattaching the at least one panel to the frame portion;

move the insulated enclosure to the first configuration; and remove the insulated enclosure from the oven chamber.

10. The method of example 9, wherein the insulated enclosure comprises a first insulated enclosure and wherein inserting the insulated enclosure into the oven chamber comprises inserting the first insulated enclosure into the oven chamber, the method comprising:

before moving the insulated enclosure from the first configuration to the second configuration, inserting a second insulated enclosure into the oven chamber adjacent to the first insulated enclosure; and coupling the first insulated enclosure to the second insulated enclosure.

11. The method of example 10, wherein— the frame portion comprises a first frame portion, the plurality of panels comprises a first plurality of panels, the second insulated enclosure includes a second plurality of panels coupled to a second frame portion, the second insulated enclosure is movable from the first configuration to the second configuration, and moving the insulated enclosure from the first configuration to the second configuration comprises moving the first insulated enclosure and the second insulated enclosure from the first configuration to the second configuration.

12. The method of example 9, further comprising:

before inserting the insulated enclosure into the over chamber, identifying a portion of the oven chamber, wherein— inserting the insulated enclosure into the oven chamber comprises positioning the insulated enclosure over the identified portion, detaching the at least one panel from the frame portion to expose at least one of the floor, the crown, and the sidewalls comprises detaching the at least one panel to expose the identified portion, and the identified portion comprises the at least one brick.

13. The method of example 9 wherein— the at least one brick comprises a first brick, and repairing the at least one brick comprises replacing the first brick with a second brick.

14. The method of example 9, wherein the coke oven is configured to burn coal at a first temperature and air surrounding the coke oven is at a second temperature less than the first temperature, the method further comprising:

before inserting the insulated enclosure into the oven chamber, cooling the oven chamber from the first temperature to third second temperature less than the first temperature and greater than the first temperature; and after removing the insulated enclosure from the oven chamber, heating the oven chamber to the first temperature.

15. An oven repairing system for repairing an oven having an oven chamber defined by a floor, a crown, and sidewalls that extend between the floor and the crown and wherein the coke oven comprises a plurality of bricks that form the floor, the crown, and the sidewalls, the oven repairing system comprising:

an insulated enclosure insertable into the oven chamber and having an interior area defined by a floor portion, a ceiling portion, and opposing first and second side portions that extend between the floor portion and the ceiling portion, the insulated enclosure comprising:

a frame portion, and a plurality of panels removably coupled to the frame portion, wherein— the plurality of panels at least partially define the floor portion, the ceiling portion, and the first and second side portions, and individual of the panels comprises an insulation portion and a backing portion coupled to the insulation portion; and a positioning apparatus, wherein the insert apparatus inserts the insulated enclosure into the oven chamber.

16. The oven repairing system of example 15 wherein the insulated enclosure comprises a first insulated enclosure and the interior area comprises a first interior area, the oven repairing system further comprising:

a second insulated enclosure insertable into the oven chamber, wherein— the positioning apparatus is configured to insert the second insulated enclosure into the oven chamber adjacent to the first apparatus, the second insulated enclosure is couplable to the first insulated enclosure, the second insulated enclosure comprises a second interior area, and the first interior area and the second interior area are fluidly connected to each other when the first and second insulated enclosures are coupled to each other.

17. The oven repairing system of example 15, wherein— the insulated enclosure is movable between a first configuration and a second configuration, and the ceiling portion is separated from the crown by a first distance when the insulated enclosure is in the first configuration and a second distance greater than the first distance when the when the insulated enclosure is in the second configuration.

18. The oven repairing system of example 17, further comprising:

insulation coupled to an exterior surface of the ceiling portion, wherein the ceiling portion is separated from the side portions by gaps when the insulated enclosure is in the first configuration and wherein the insulation extends over the gaps.

19. The oven repairing system of example 15 wherein, when the insulated enclosure is inserted into the oven chamber, the floor portion is positioned adjacent to the floor of the oven, the first side portion is positioned adjacent to a first of the sidewalls, the second side portion is positioned adjacent to a second of the sidewalls, and the ceiling portion is positioned adjacent to the crown.

20. The oven repairing system of example 15 wherein— the plurality of panels comprises a first panel configured to be removed from the frame portion, and at least one of the brick is exposed to the interior area when the first panel is decoupled from the frame portion.

To the extent any materials incorporated herein by reference conflict with the present disclosure, the present disclosure controls. As used herein, the phrase "and/or" as in "A and/or B" refers to A alone, B alone, and both A and B. The following examples provide further representative features of the present technology.

We claim:

1. A method of repairing a coke oven having an oven chamber defined by a floor, a crown, and sidewalls that extend between the floor and the crown and wherein the coke oven comprises a plurality of bricks that form the floor, the crown, and the sidewalls, the method comprising:

inserting an insulated enclosure into the oven chamber, wherein— the insulated enclosure includes a frame portion, and a plurality of panels removably coupled to the frame portion, the insulated enclosure is movable between a first collapsed configuration and a second expanded configuration, the first configuration having a first dimension measured along an axis between opposing end portions of the frame portion, and the second configuration having a second dimension measured along the axis between the opposing end portions of the frame portion, the dimension being different than second dimension, and inserting the insulated enclosure into the oven chamber comprises inserting the insulated enclosure into the oven chamber when the insulated enclosure is in the first configuration;

moving the insulated enclosure from the first configuration to the second configuration;

detaching at least one of the panels from the frame portion to expose at least one of the floor, the crown, and the sidewalls;

repairing at least one of the bricks;

reattaching the at least one panel to the frame portion;

moving the insulated enclosure to the first configuration; and removing the insulated enclosure from the oven chamber.

2. The method of claim 1, wherein the insulated enclosure comprises a first insulated enclosure and wherein inserting the insulated enclosure into the oven chamber comprises inserting the first insulated enclosure into the oven chamber, the method comprising:

before moving the insulated enclosure from the first configuration to the second configuration, inserting a second insulated enclosure into the oven chamber adjacent to the first insulated enclosure; and coupling the first insulated enclosure to the second insulated enclosure.

3. The method of claim 2, wherein— the frame portion comprises a first frame portion, the plurality of panels comprises a first plurality of panels, the second insulated enclosure includes a second plurality of panels coupled to a second frame portion, the second insulated enclosure is movable from the first configuration to the second configuration, and moving the insulated enclosure from the first configuration to the second configuration comprises moving the first insulated enclosure and the second insulated enclosure from the first configuration to the second configuration.

4. The method of claim 1, further comprising:

before inserting the insulated enclosure into the over chamber, identifying a portion of the oven chamber, wherein— inserting the insulated enclosure into the oven chamber comprises positioning the insulated enclosure over the identified portion, detaching the at least one panel from the frame portion to expose at least one of the floor, the crown, and the sidewalls comprises detaching the at least one panel to expose the identified portion, and the identified portion comprises the at least one brick.

5. The method of claim 1 wherein— the at least one brick comprises a first brick, and repairing the at least one brick comprises replacing the first brick with a second brick.

6. The method of claim 1, wherein the coke oven is configured to coke coal at a first temperature and air surrounding the coke oven is at a second temperature less than the first temperature, the method further comprising:

before inserting the insulated enclosure into the oven chamber, cooling the oven chamber from the first temperature to third second temperature less than the first temperature and greater than the first temperature; and after removing the insulated enclosure from the oven chamber, heating the oven chamber to the first temperature.

7. A method of repairing a coke oven, the method comprising:

inserting an insulated enclosure, having a first collapsed configuration, into an oven chamber including a plurality of bricks, the insulated enclosure including a frame portion and a plurality of panels removably coupled to the frame portion;

altering the insulated enclosure to have a second expanded configuration relative to the first configuration, the first configuration having a first dimension measured along an axis between opposing end portions of the frame portion, and the second configured having a second dimension measured along the axis between the opposing end portions of the frame portion, the first dimension being different than the second dimension;

detaching at least one of the panels from the frame portion to expose a portion of the bricks of the coke oven; and repairing at least one of the bricks.

8. The method of claim 7, further comprising:

reattaching the at least one panel to the frame portion;

altering the insulated enclosure to have the first configuration; and removing the insulated enclosure from the oven chamber.

9. The method of claim 7, wherein the insulated enclosure comprises a first insulated enclosure, the method further comprising:

before altering the first insulated enclosure to have the second configuration, inserting a second insulated enclosure into the oven chamber adjacent to the first insulated enclosure; and coupling the first insulated enclosure to the second insulated enclosure.

10. The method of claim 7, wherein:

inserting the insulated enclosure into the oven chamber comprises positioning the insulated enclosure over a previously-identified portion comprising the at least one brick, and detaching the at least one panel comprises detaching the at least one panel to expose the identified portion.

11. The method of claim 7, wherein the coke oven is configured to coke coal at a first temperature and air surrounding the coke oven is at a second temperature less than the first temperature, the method further comprising, before inserting the insulated enclosure into the oven chamber, cooling the oven chamber to a third temperature between the first temperature and the second temperature.

12. The method of claim 11, further comprising, after removing the insulated enclosure from the oven chamber, heating the oven chamber to the first temperature.

13. A method of repairing a coke oven, the method comprising:

providing an enclosure configured to be inserted into a coke oven comprising a plurality of structural components, the enclosure comprising a frame defining an outermost region of the enclosure and a plurality of panels removably coupled to the frame, wherein the enclosure is movable from a first collapsed configuration having a first dimension measured along an axis between opposing end portions of the frame to a second expanded configuration having a second dimension measured along the axis between the opposing end portions of the frame, the first dimension being different than the second dimension;

inserting the enclosure into the coke oven, and repairing the coke oven.

14. The method of claim 13, wherein the first dimension comprises a first height and the second dimension comprises a second height greater than the first dimension.

15. The method of claim 13, wherein inserting the enclosure comprises inserting the enclosure in the first configuration, the method further comprising:

after inserting the enclosure, causing the enclosure to transition to the second configuration;

after causing the enclosure to transition to the second configuration, collapsing the enclosure; and after collapsing the enclosure, removing the enclosure from the coke oven.

* * * * *